US005595097A

United States Patent [19]

Anderson

[11] Patent Number: 5,595,097

[45] Date of Patent: Jan. 21, 1997

[54] TWO-SIDED, MULTI-ANGLED WRENCH

[76] Inventor: Steven P. Anderson, 6660 Reseda Blvd., #112, Reseda, Calif. 91335

[21] Appl. No.: 381,221

[22] Filed: Jan. 31, 1995

[51] Int. Cl.[6] ..... B25B 13/04

[52] U.S. Cl. ..... 81/125.1; 81/124.4; 81/124.3

[58] Field of Search ..... 81/125.1, 119, 81/121.1, 124.3, 124.4, 124.7, 177.1, 177.2, 177.8, 177.7, 177.9

[56] References Cited

U.S. PATENT DOCUMENTS

| | | | |
|---|---|---|---|
| 1,053,536 | 2/1913 | Sargent | 81/124.4 |
| 1,830,143 | 11/1931 | Taylor | 81/124.3 X |
| 2,358,555 | 9/1944 | Blanchard | 81/119 X |
| 2,426,763 | 9/1947 | Curtis | 81/177.8 X |
| 4,275,622 | 6/1981 | Ford | 81/125.1 |
| 4,685,164 | 8/1987 | Sebalos | 81/119 X |

*Primary Examiner*—D. S. Meislin

*Attorney, Agent, or Firm*—Albert O. Cota

[57] ABSTRACT

A double-ended, multi-angled wrench (10) that is particularly designed to allow a user to loosen or tighten a bolt or nut (60) located within or near a set of obstructions (64, 66, 68). A wrench (10) that incorporates a twelve-point box end (24), can be easily positioned to allow up to forty-eight ascending (pulling) or descending (pushing) torque increments to be applied to the bolt or nut, and the multi-angled design of the wrench allows a user to comfortably grasp the wrench (10) when the torque is being applied. The wrench (10) consists of a horizontal section (12) having a first end (14) and a second end (16). Integral with the first end (14) is a first section (18) that angles outwardly 120° and integral with the second end (16) is a second section (30) that angles outwardly 120°. From the opposite end of the section (30) is an integral third section (40) that angles outwardly 60°. The bolt or nut gripping ends (22, 44) of the first and third outward angled sections (18, 40) can be made in either a box end (24) or a open end (26).

17 Claims, 5 Drawing Sheets

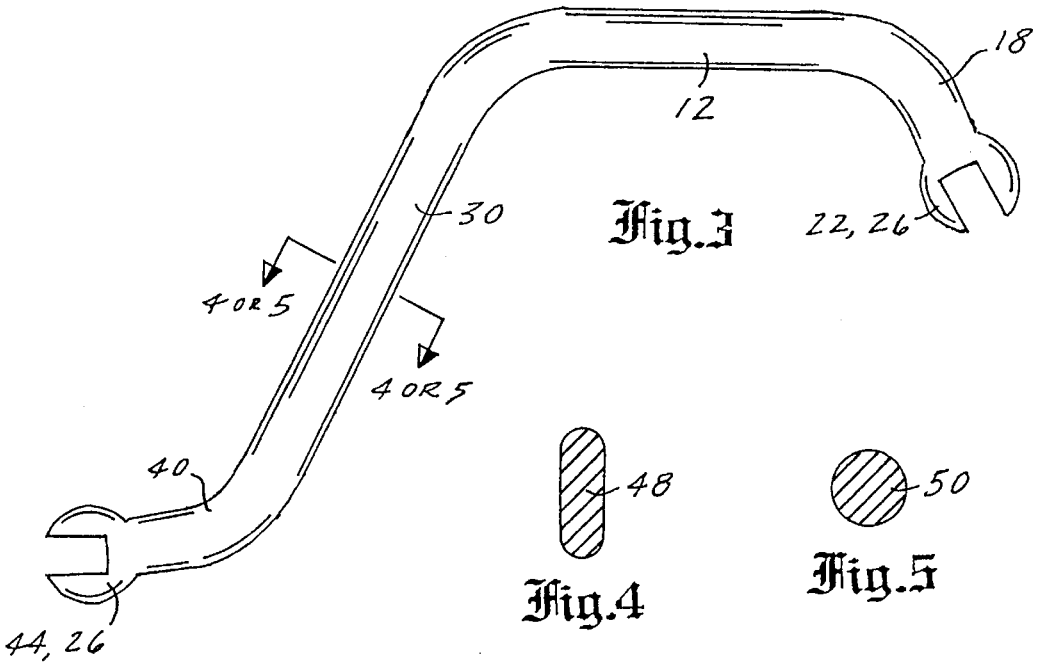
Fig.3
Fig.4
Fig.5
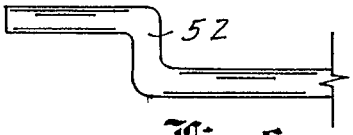
Fig.6
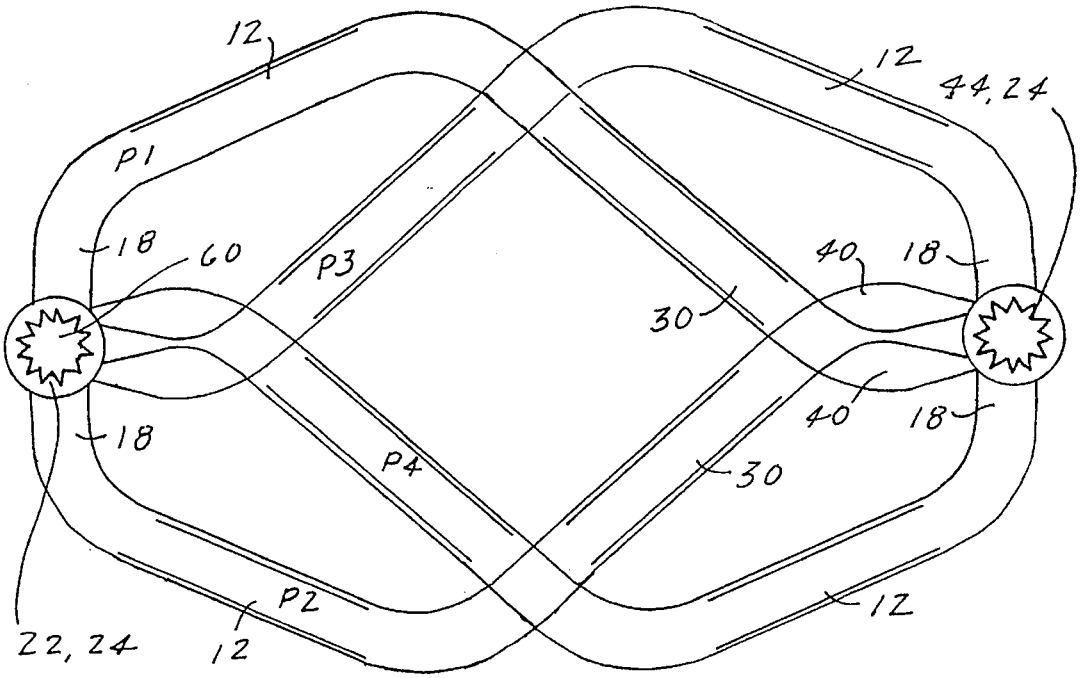
Fig.7

TWO-SIDED, MULTI-ANGLED WRENCH

TECHNICAL FIELD

The invention pertains to the general field of box and end wrenches and more particularly to a two-sided, multi-angled wrench that allows a user to loosen or tighten a bolt or nut located within or near an obstructed area.

BACKGROUND ART

The utility and convenience of using a single or two-sided box or end wrench is well established. These wrenches can be purchased in various lengths and socket sizes and most often are designed with a straight body. However, specialized wrenches are also available that have a curved body to accommodate a particular application.

Most box and open end wrenches, because of their straight body design, are limited to being used on bolts and nuts that are accessible. When a bolt or nut is located within or near an obstruction, it is very difficult, at best, to properly place the wrench over the bolt or nut. Additionally, because of the obstruction it is even more difficult to grip the wrench so that a pushing or pulling torque can be applied to the bolt or nut at practical angular displacement strokes.

A search of the prior art, which included patents and catalog items, disclosed some two-sided and multi-angled wrenches. However none of the wrenches disclosed multi-angled wrenches that had been designed to allow a user to apply a practical and convenient pushing or pulling torque to a bolt or nut that was located near or within an obstructed area. Although none of the patents read on the claims of the instant invention, the following U.S. patents are considered related:

| U.S. PAT. NO. | INVENTOR | ISSUED |
|---|---|---|
| 1,424,676 | Parsons | 1 August 1922 |
| 1,348,570 | Knight | 3 August 1920 |

The Parsons U.S. Pat. No. 1,424,676 discloses a wrench that includes a handle having a detachable head. The head is provided with a plurality of jaws to fit different sized nuts. The handle is also adapted to be turned end-for-end on the handle to bring the various jaws, one at a time into an operative position. Preferably, two of the heads are employed, one at each end of the handle, to multiply the number of jaws of different sizes.

The Knight U.S. Pat. No. 1,348,570 discloses a valve-spring lifter wrench that includes a central flat metal section. On each side of the central section is located a slotted head which is adaptable to strattle a valve stem. The slot in one head is larger than the slot in the other head, thus permitting the heads to strattle valve stems of different diameters. Also, the central section is substantially straight while the heads are laterally offset in opposite directions. This design forms an S-shaped wrench which has an advantage over a straight wrench in that it will not interfere with the user's hands when a valve spring pin is being removed or inserted.

For background purposes and as indicative of the art to which the invention relates reference may be made to the remaining cited patents and catalog items.

| U.S. PAT. NO. | INVENTOR | ISSUED |
|---|---|---|
| 3,109,334 | Miranda | 5 November 1963 |
| 1,639,269 | Potschner | 16 August 1927 |
| 31,693 | Phillips | 12 March 1861 |

CATALOG ITEMS

Cummings micro-turn air compressor wrench-This specialized wrench is made in an S-shape that includes a central section with a box end wrench on each terminating end.

McMaster-Carr Supply Company 1992 catalog pages 1733–1745.

DISCLOSURE OF THE INVENTION

The double-ended, multi-angled end wrench is particularly designed to allow a user to apply either a pushing or a pulling torque to a bolt or nut located near or within an obstructed area. In its most basic design, the inventive wrench consists of four integral elements:

1. A horizontal section that has a first end and a second end.
2. A first outward section having a first end and a first bolt or nut gripping that may consist of either a box end or an open end. The first end is integral with the first end of the horizontal section.
3. A second outward angled section having a first end and a second end. The first end is integral with the second end of the horizontal section.
4. A third outward angled section having a first end and a second bolt or nut gripping end that may also consist of either a box end or an open end. The first end is integral with the second end of the second outward angled sections.

The multi-angled design of the wrench includes three angles that are referenced from the horizontal section. These three angles in combination with the angular position of the wrench allows the wrench to be placed over any point of a bolt or nut in four torque applying positions.

In the first position, the first bolt or nut gripping end is placed over a bolt or nut and the wrench is gripped around the second and third outward angled sections. In the second position, the wrench is rotated 180° and the first bolt or nut gripping end is placed over the bolt or nut with the wrench gripped around the second and third outward angled sections. In the third position, the second bolt or nut gripping end is placed over a bolt or nut and the wrench is gripped around the first outward angled section and the horizontal section. In the fourth position, the wrench is once again rotated 180° and the second bolt or nut gripping is placed over a bolt or nut and the wrench is gripped by placing the hand over the first outward angled section and the horizontal section.

The multi-angled design of the wrench, in combination with a twelve-point socket head, allows a user to select over a 360° arc, a pulling or a pulling torque in forty-eight ascending or descending angular increments. This feature is particularly useful when the wrench is being used to loosen or tighten a bolt or nut that is located within an obstructed area where small rotational increments must be used to rotate the bolt.

In view of the above disclosure, it is the primary object of the invention to provide a wrench that can be used in several positions and that provides a large rotational torque displacement that can be applied in either a pulling or a pushing torque.

In addition to the primary object of the invention it is also an object of the invention to produce a wrench that:

can be made in various sizes and lengths, can be made with either a box end on each end, an open end on each end or with a combination of box and open ends.

allows a user to grasp the wrench in a position that is further from the body to thus provide better extension and torque, allows a pushing or pulling torque to be applied in either a vertical or horizontal position, can be held comfortably between the thumb and fingers so that the wrench is less likely to fall from the hand when it is being used in an awkward position, and is cost effective from both a manufacturing and consumer points of view.

These and other objects and advantages of the present invention will become apparent from the subsequent detailed description of the preferred embodiment and the appended claims taken in conjunction with the accompanying drawings.

BRIEF DESCRIPTION OF THE DRAWINGS

FIG. 3 is an elevational side view of the wrench rotated 180° and that terminates at each end with an open end wrench.

FIG. 4 is a rectangular cross-sectional view of the wrench taken along the lines 4–4 of FIG. 3.

FIG. 5 is a circular cross-sectional view of the wrench taken along the lines 4–4 of FIG. 3.

FIG. 6 is a partial, top plan view of the wrench having a terminating end that includes an offset.

FIG. 7 is an elevational side view of the wrench showing the four torque applying positions available with the wrench.

BEST MODE FOR CARRYING OUT THE INVENTION

Figure 1:
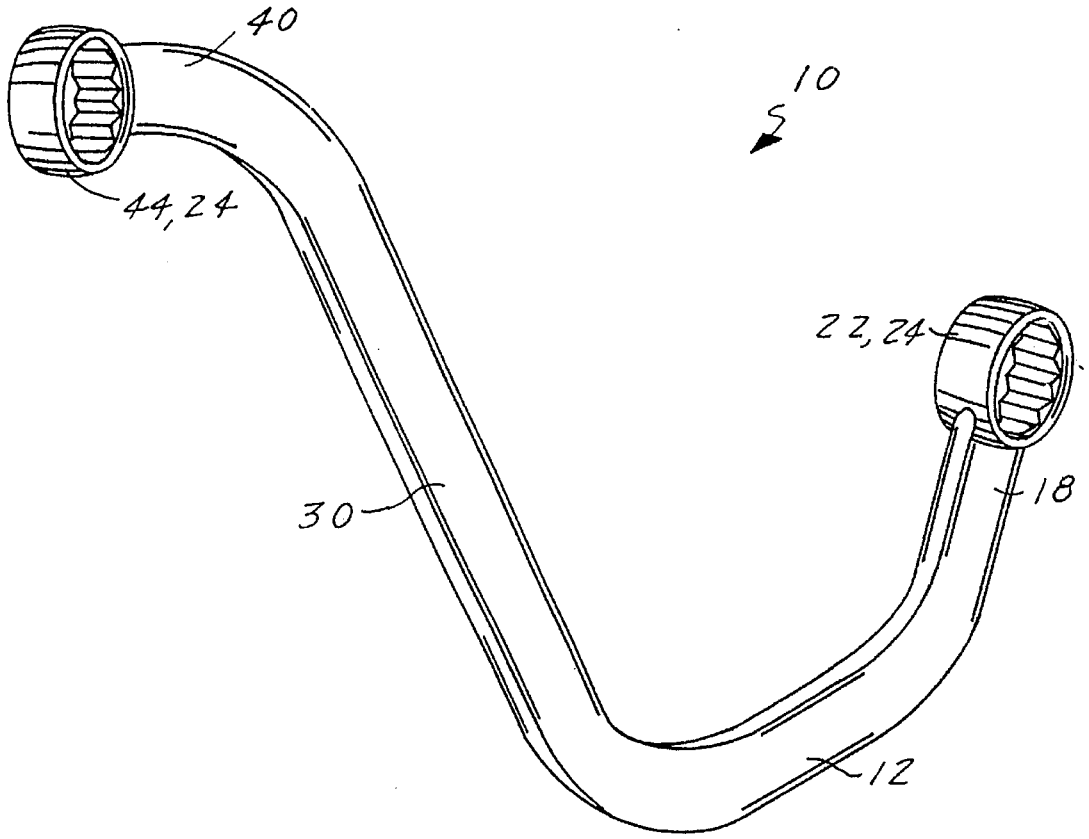
FIG. 1 is a perspective view of a double-ended, multi-angled wrench.

The best mode for carrying out the double-ended multi-angled end wrench 10 is presented in terms of a preferred embodiment that allows the wrench to loosen or tighten a bolt or nut 60 located near or within an obstructed area. The preferred embodiment of the wrench 10 as shown in FIGS. 1–9 is comprised of the following integral elements: a horizontal section 12, a first outward angled section 18, a second outward angled section 30 and a third outward angled section 40.

Figure 2:
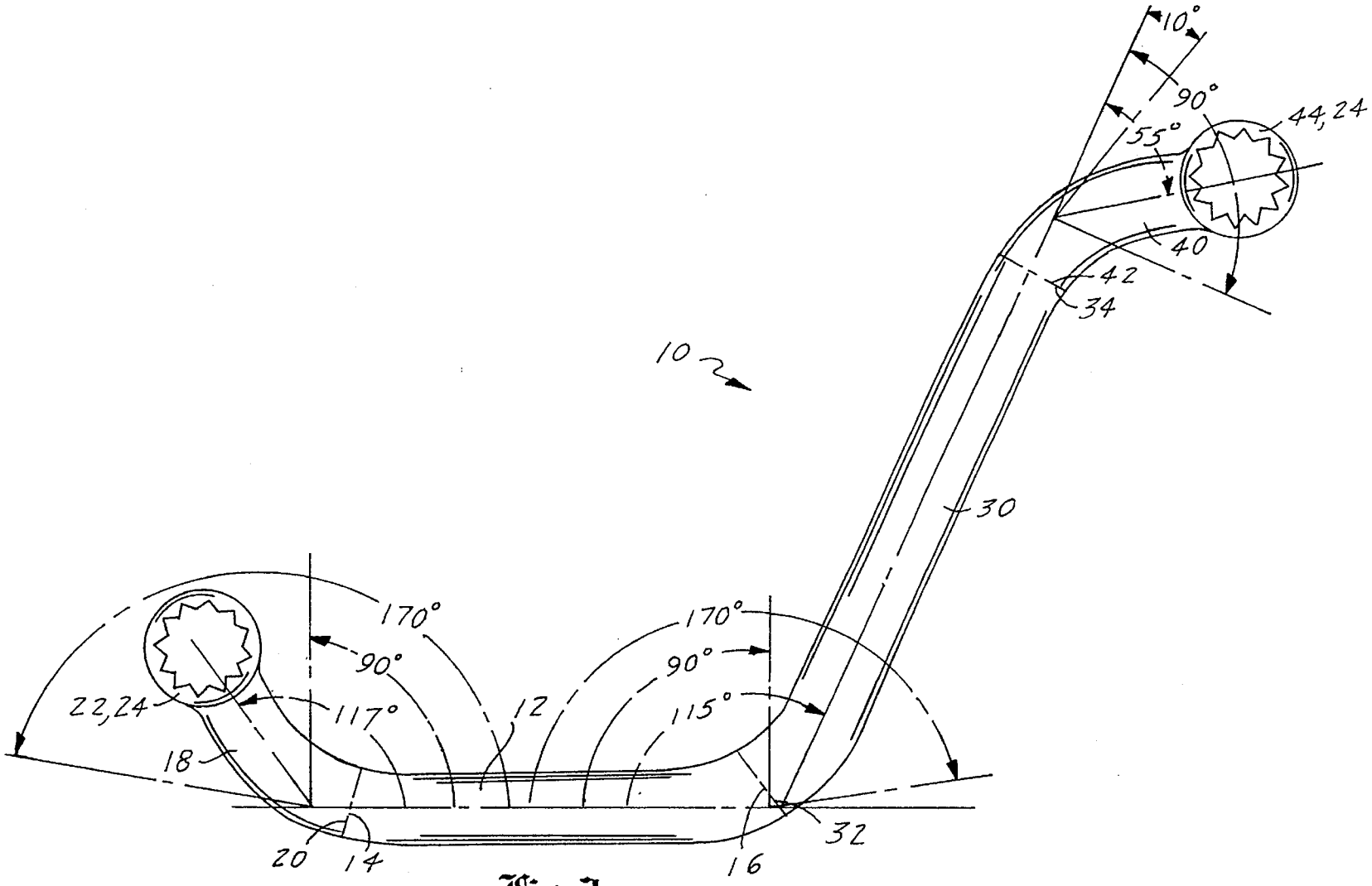
FIG. 2 is an elevational side view of the wrench that terminates at each end with a box end.

The wrench 10 as shown in FIGS. 1, 2 and 3, consists of the horizontal section 12 which includes a first end 14 and a second end 16.

The first outward angled section 18 as also shown in FIGS. 2 and 3, consists of a first end 20 and a first bolt or nut gripping end 22. The first end 20 is integral with the first end 14 of the horizontal section 12. The outward angle of the section 18 may be displaced between ninety degrees (90°) and one-hundred seventy degrees (170°) as measured counter-clockwise from the horizontal section 12 and as shown by the broken lines in FIG. 2. However, as also shown in FIG. 2 by the solid lines, the preferred angular displacement of the section 18 is one-hundred seventeen degrees (117°) as measured counter-clockwise from the horizontal section 12.

The second outward angled section 30 as also shown in FIGS. 2 and 3 includes a first end 32 and a second end 34. The first end 32 is integral with to the second end 16 of the horizontal section 12. The angle of the section 30 ranges between ninety degrees (90°) and one-hundred seventy degrees (170°) as measured clockwise from the horizontal section 12 and as shown by the broken lines in FIG. 2. The preferred angular displacement of the second outward angled section 30 is one-hundred fifteen degrees (115°) as measured clockwise from the horizontal section and as shown by the solid lines in FIG. 2.

The third outward angled section 40 as shown in FIGS. 2 and 3, consists of a first end 42 and a second bolt or nut gripping end 40. The first end 42 is integral with the second end 34 of the second outward angled section 30. The outward angle of the section 40 may range between ten degrees (10°) and ninety degrees (90°) as measured clockwise from the second outward angled section 30 and as shown by the dashed lines in FIG. 2. The preferred angular displacement of the section 40 as shown by the solid lines, is fifty-five degrees (55°).

As shown in FIG. 2, both the first and second bolt or nut gripping ends 22,44 may consist of box ends 24. Alternatively, as shown in FIG. 3, both the ends 22,44 may also be manufactured with open ends 26. In a third design (not shown) the end 22 may consist of a box end and the end 44 an open end 26 or vise versa, the end 22 may have an open end and the end 44 a box end.

The wrench 10 is preferably manufactured with the horizontal section 12, the first outward angled section 18, the second outward angled section 20 and the third outward angled section 40 having a narrow, rectangular cross section 48 as shown in FIG. 4. The wrench 10 may alternatively be constructed with all of the above sections, having a circular cross section 50 as shown in FIG. 5. Additionally, the first angled outward section 18 and/or the third outward angled section 40 may include an offset 52 as shown in FIG. 6. This offset provides the wrench with a maximum obstruction clearance.

The wrench 10 can be made in various lengths and sizes that vary in accordance with its intended use. For most applications, a wrench with the following dimensions was found to have the greatest utility: a horizontal section 12 having a length of 3.25 inches (8.25 cm); a first outward angled section 18 having a length of 1.75 inches (4.45 cm); a second outward section 30 having a length of 4.38 inches (11.30 cm); and a third outward angled section 40 having a length of 1.75 inches (4.45 cm). The above dimensions produce a wrench 10 having an overall length of 8.69 inches (22.1 cm). This overall length can either be shortened to produce a "stubby" wrench or lengthened. Preferably, the wrench is made of a drop-forged alloy-steel that is heat treated and chrome plated.

The wrench 10 is designed to allow the wrench's first and second bolt or nut gripping ends 22,44 to be placed over the same point on a hex bolt or nut 60, in four torque applying positions as shown in FIG. 7. To illustrate these four poritions, the first and second bolt or not gripping ends 22,44 are placed in the same horizontal plane.

In the first torque applying position, designated by "P1" in FIG. 7, the first bolt or nut gripping end 22 is placed over a bolt or nut 60 and the wrench 10 is gripped around the second and third outward angled sections 30,40. In the second torque applying position, designated by "P2" in FIG. 7, the wrench is rotated one-hundred eighty degrees (180°). The first bolt or nut gripping end 22 is then placed over a bolt or nut 60 and the wrench 10 is gripped around the second and third outward angled sections 30,40. In the third torque applying position designed by "P3" in FIG. 7, the second bolt or nut gripping end 44 is placed over a bolt or nut 60 and the wrench 10 is gripped around the first outward angled section 18 and the horizontal section 12. In the fourth and final torque applying position designated by "P4" in FIG. 7, the wrench is rotated one-hundred eighty degrees (180°). The second bolt or nut gripping end 44 is then placed over a bolt or nut 60 and the wrench 10 is gripped around the first outward angled section 18 and the horizontal section 12.

The wrench 10 as described above can be utilized as would any standard box end or open end wrench. However, the inventive wrench 10 provides additional utility in its superior torque application capabilities. These torquing capabilities are provided by the multi-angled design of the wrench which allows a user to selectively push or pull on the wrench 10 to apply the required torque to a bolt or nut 60. The multi-angled design also allows the wrench 10 to reach and loosen or tighten a bolt or nut 60 that is located within or near an obstructed area as shown in FIG. 8.

Figure 8:
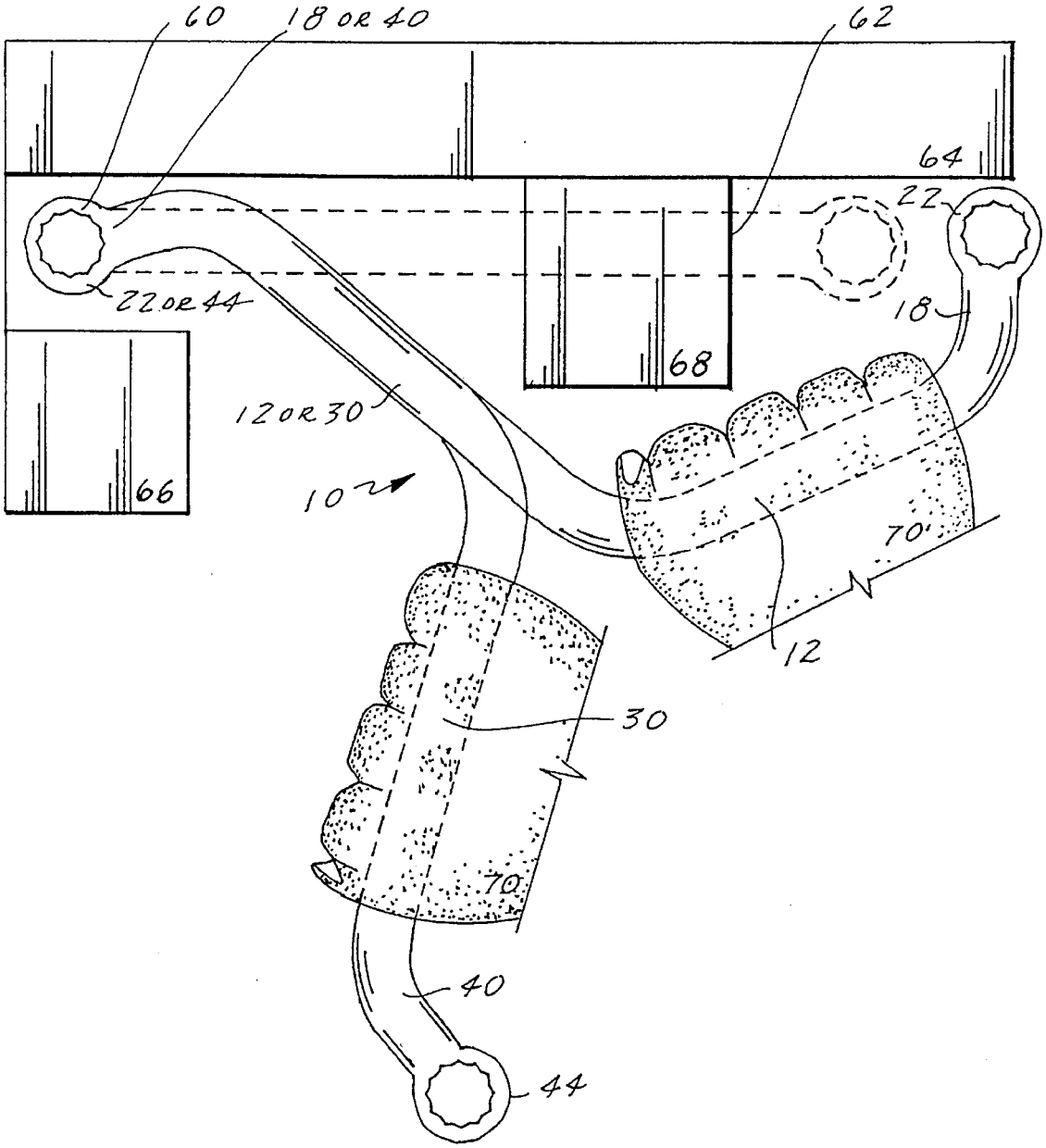
FIG. 8 is an elevational side view of the wrench that compares a conventional end wrench, shown by broken lines, with the inventive wrench, when the wrenches are being used to loosen or tighten a bolt or nut located within or near an obstructed area.

Referring to FIG. 8, a conventional box or end wrench 62 depicted by broken lines is comparatively shown with the inventive wrench 10 which is depicted in two different positions. Both wrenches are being utilized to loosen or tighten a bolt or nut 60 that is located within and between an upper obstruction 64, a forward-lower obstruction 66 and a center-lower obstruction 68.

As can be seen in FIG. 8, if a center-lower obstruction 68 is present, as is common in many automobile engines, it is impossible or at best very difficult to utilize a conventional wrench 62.

In contrast, as also shown in FIG. 8, the wrench 10 can be inserted into the bolt or nut 60 with its second bolt or nut gripping end 44 which is attached to the third outward angled section 40. In this position, the second outward angled section 30 and the horizontal section 12 easily overcome the upper, forward-lower and center lower obstructions 64,66 and 68. The sections 12 and/or 30 can then be easily and comfortably grasped by a hand 70 to allow a user to apply either a pulling or pushing torque to the bolt or nut 60. If the above wrench position is insufficient to apply the required torque, the wrench can be removed and rotated. When rotated, the first bolt or nut gripping end 22 which is attached to the first outward angled section 18, can be inserted into the bolt or nut 60. In this new position, the wrench's second outward angled section 30 is located in a near vertical position, as also shown in FIG. 8, which allows a user to grasp the section 30 and again apply either a pulling or pushing torque to the bolt or nut 60.

The final inventive feature is described in terms of a wrench 10 that incorporates a twelve-point box end 24 that engages a standard hex bolt or nut 60.

Figure 9:
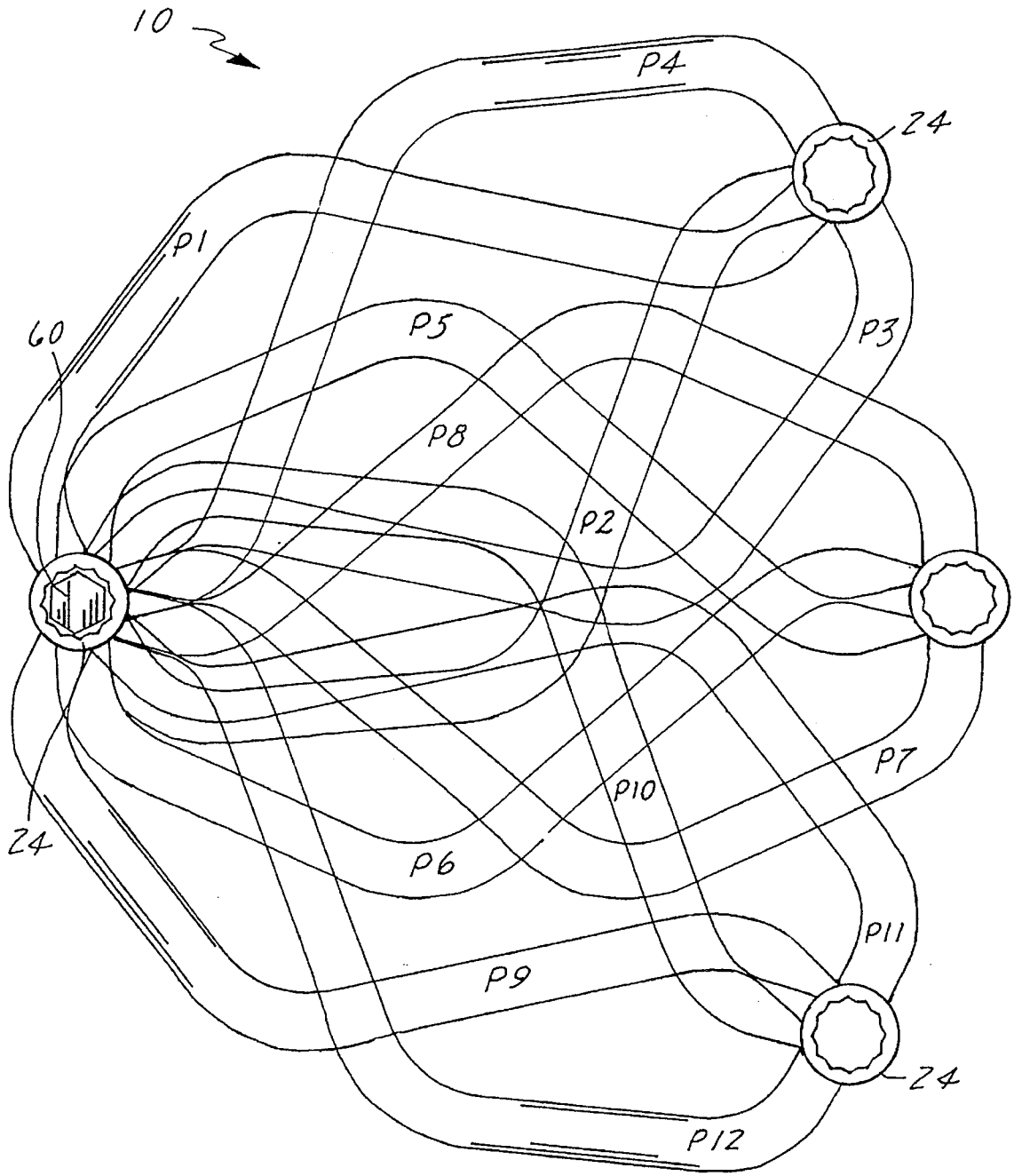
FIG. 9 is a composite side view of the wrench illustrating how a twelve-point box end of a wrench can be inserted into a bolt or nut and be displaced through three of its points to produce twelve ascending or descending torque applications positions.

For each of the wrench's twelve points there are four torque application positions as shown in FIG. 7. Therefore, the wrench 10 over a 360° rotation can provide forty-eight torque application positions. For example, in FIG. 9, is shown a composite side view of the wrench 10 attached to a bolt or nut 60. The bolt or nut 60 is being displaced through three points of the wrench 10 for a total of twelve descending (pushing) or ascending (pulling) torque application positions designated as P1–P12 in the figure.

While the invention has been described in complete detail and pictorially shown in the accompanying drawings it is not to be limited to such details, since many changes and modifications may be made in the invention without departing from the spirit and scope thereof. Hence, it is described to cover any and all modifications and forms which may come within the language and scope of the appended claims.

I claim:

1. A double-ended, multi-angled end wrench comprising:

a) a horizontal section having a first end and a second end, b) a first outward angled section having a first end and a first bolt or nut gripping end, where the first end is integral with the first end of said horizontal section, and angles outwardly substantially one-hundred seventeen degrees (117°) as measured counter-clockwise from said horizontal section, c) a second outward angled section having a first end and a second end, where the first end is integral with the second end of said horizontal section, and angles outward substantially one-hundred fifteen degrees (115°) as measured clockwise from said horizontal section, and d) a third outward angled section having a first end and a second bolt or nut gripping end, where the first end is integral with the second end of said second outwardly angled section and angles outward substantially fifty-five degrees (55°) as measured clockwise from said second outward angled section.

2. The wrench as specified in claim 1 wherein said first and second bolt or nut gripping ends comprises a box end.

3. The wrench as specified in claim 1 wherein said first and second bolt or nut gripping end comprises an open end.

4. The wrench as specified in claim 1 wherein said first bolt or nut gripping end comprises an open end and said second bolt or nut terminating end comprises a box end.

5. The wrench as specified in claim 1 wherein said first bolt or nut gripping end comprises a box end and said second bolt or nut terminating end comprises an open end.

6. The wrench as specified in claim 1 wherein said horizontal section, first outward angled section, second outward angled section and said third outward angled section are in alignment and have a radiused rectangular cross section.

7. The wrench as specified in claim 1 wherein said horizontal section, first outward angled section, second outward angled section and said third outward angled section are in alignment and have a circular cross section.

8. The wrench as specified in claim 1 wherein the first and second bolt or nut gripping end, each further comprise a twelve-point socket head, which allows said wrench to be positioned to permit a hex bolt or nut to be loosened and tightened in up to forty-eight ascending or descending angular torque increments providing 360° rotation of the wrench.

9. The wrench as specified in claim 1 wherein said first and second bolt gripping end is offset to provide maximum obstruction clearance.

10. The wrench as specified in claim 1 wherein said first and second bolt gripping ends are each offset to one another to provide maximum obstruction clearance.

11. A multi-angled wrench for rotationally engaging an object, comprising:

a) an elongated body situated along a rotational plane extending longitudinally through the body, the body comprising:

(1) first and second outwardly angled sections, (2) a horizontal section formed integral with the first and second sections and situated between the first and second sections and, (3) a third outwardly angled section formed integral with the second section, the first section being oriented at an angle of substantially between 107 and 127 degrees as measured counterclockwise with respect to a horizontal section axis extending axially through the horizontal section, the second section being oriented at an angle substantially between 105 and 125 degrees as measured clockwise with respect to the horizontal section axis, and the third section being oriented at an angle of substantially between 10 and 90 degrees as measured clockwise with respect to a second section axis extending axially through the second section; and b) first and second heads formed integral with the first and third sections respectively and configured to rotationally engage the object along an axis substantially perpendicular to the rotational plane.

12. The multi-angled wrench as specified in claim 11 wherein the angles of orientation of the first and second sections are substantially 117 and 115 degrees respectively.

13. The multi-angled wrench as specified in claim 11 wherein the angle of orientation of the third section is substantially about 55 degrees.

14. The multi-angled wrench as specified in claim 11 wherein the angle of orientation of the third section is substantially between 45 and 65 degrees.

15. The multi-angled wrench as specified in claim 11 wherein the angle of orientation of the third section is substantially between 50 and 60 degrees.

16. A multi-angled wrench for rotationally engaging an object, comprising:

a) an elongated body comprising:

(1) first and second outwardly angled sections, (2) a horizontal section formed integral with the first and second sections and situated between the first and second sections and (3) a third outwardly angled section formed integral with the second section, the first section being oriented at an angle of substantially between 107 and 127 degrees as measured counterclockwise with respect to a horizontal section axis extending axially through the horizontal section, the second section being oriented at an angle substantially between 105 and 125 degrees as measured clockwise with respect to the horizontal section axis, and the third section being orientated at an angle of substantially between 10 and 90 degrees as measured clockwise with respect to a second section axis extending axially through the second section, and b) first and second heads formed integral with the first and third sections respectively and configured to rotationally engage the object.

17. The multi-angled wrench as specified in claim 16 wherein the angle of orientation of the third section is substantially between 45 and 65 degrees.

* * * * *